United States Patent [19]

Beard

[11] 4,190,272

[45] Feb. 26, 1980

[54] SCREW LOCK FOR INTERLOCKING SLIDING DOOR AND WINDOWS

[76] Inventor: Eugene R. Beard, 3186 Reva Dr., Concord, Calif. 94519

[21] Appl. No.: 926,538

[22] Filed: Jul. 20, 1978

[51] Int. Cl.[2] ..... E05C 5/04

[52] U.S. Cl. ..... 292/251; 292/62; 292/DIG. 46

[58] Field of Search ..... 292/251, 62, DIG. 46, 292/57, 59, 60, 61

[56] References Cited

U.S. PATENT DOCUMENTS

| | | | |
|---|---|---|---|
| 1,639,661 | 8/1927 | Newcomb | 292/62 X |
| 2,198,161 | 4/1940 | Grady et al. | 292/62 |
| 2,468,646 | 4/1949 | Verhoff | 292/251 |
| 3,397,000 | 8/1968 | Nakanishi | 292/61 |
| 4,068,874 | 1/1978 | Fleming et al. | 292/DIG. 46 |

*Primary Examiner*—Richard E. Moore
*Attorney, Agent, or Firm*—James R. Cypher

[57] ABSTRACT

A screw lock permanently mounted on a sliding panel includes a finger engageable means mounted on a lock bolt threaded at its distal end. A spring biases the bolt to an unlatched position. A keeper member formed with a threaded opening is mounted on a fixed panel for registration with the threaded lock bolt in the closed panel position. A flange on the sliding panel interlocks with a flange on the fixed panel in the closed position.

3 Claims, 5 Drawing Figures

SCREW LOCK FOR INTERLOCKING SLIDING DOOR AND WINDOWS

BACKGROUND OF THE INVENTION

This application sets forth an improvement of my prior filed application entitled PANEL MOUNTED EXTERIOR KEYED LOCK FOR SLIDING DOORS AND WINDOWS filed Oct. 13, 1977, Ser. No. 841,920, now U.S. Pat. No. 4,154,467 granted May 15, 1979.

This invention relates to locks for sliding doors and windows which not only have frame members which slide by one another but also interlock in the closed mode.

In my previous invention, the screw lock did not automatically retract the bolt and when not properly retracted, damage could occur to the threaded end of the bolt if it was accidentally left protruding beyond the face of the keeper and the door was slammed shut. Further, if the threads in the keeper become stripped, it was not readily apparent from merely turning the key and the door could be forced open.

I have observed that homeowners will spend several thousand dollars on furnishings including expensive television sets, hi-fidelity equipment and then express extreme dismay when all is lost due to a patio door lock which took a burglar less than thirty (30) seconds to pry open. A trip to the local hardware store to buy a secure lock is equally frustrating because there is simply no secure lock available for a sliding interlocking patio door.

A search of existing patents, again does not disclose a solution to the problem. Busby, U.S. Pat. No. 2,018,346 was granted a patent on Oct. 22, 1935 for locking a double hung window. Although he used a threaded bolt, the screws in the lock can be easily pried out since a bar can be placed between frame members 10. Note that the frame members 10 do not interlock with one another. On Sept. 27, 1938, Dunseath was granted U.S. Pat. No. 2,131,315 for a lock for sliding panels on a display case. Again, Rails 4 and 5 of the sliding doors do not interlock with one another.

Crossley invented a lock for an automobile head light and was granted U.S. Pat. No. 1,571,574 on Feb. 2, 1926. Crossley used a threaded bolt, but door 2 did not interlock with housing 1.

Finally, Kaufman, on July 15, 1947 was granted U.S. Pat. No. 2,423,982 for a lock for folding gates. Again, vertical end members 14 and 15 of the gate simply abut one another rather than interlock with one another.

In contrast, this invention discloses a lock for use with frame members which interlock.

SUMMARY OF THE INVENTION

The gist of the present invention is the use of a screw type lock in combination with a patio door or window having interlocking frame members in which the bolt is biased to a retracted position.

The main purpose of the present invention is to keep the bolt automatically retracted until the bolt is manually operated to lock the door or window.

An object of the present invention is to provide a screw type lock in combination with interlocking door or window panels in a manner never before shown so as to effect a locking of the panels so securely that they cannot be forcibly parted without destroying the panels.

Another advantage of the retracted bolt is the fact that the lock will not operate if either the threads on the bolt or the keeper are stripped. The home owner will known immediately whether the lock is operational; rather than after his home has been burglarized.

DESCRIPTION OF THE INVENTION

Figure 1:
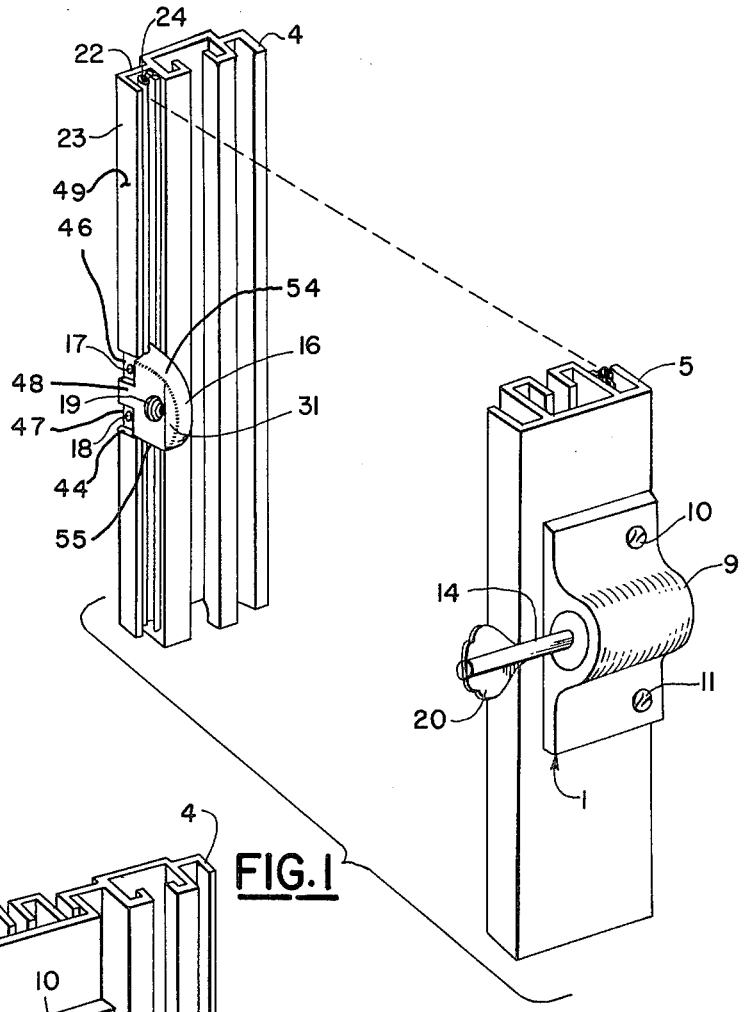
FIG. 1 is a perspective view of the lock of the present invention and a portion of a sliding door or window having interlocking frame members in which the panels have been moved relative to each other to the open and unlocked position.

The present invention consists briefly of a lock 1 for use with a pair of closure panels 2 and 3, each having an interlocking frame member 4 and 5. At least one of the closure members is slidably mounted in tracks 7 and 8.

The lock consists of a lock housing 9 affixed to one of the interlocking frame members such as member 5 as by one-way screws 10 and 11. The housing is formed with an opening 12 therethrough dimensioned to receive a rotatable lock member 13. The lock member includes an axially movable bolt 14 which is movable axially of the lock member and formed with threads 15 at its distal end.

A spring 36 such as a cone spring is inserted into chamber 12 and bears against first wall 37 of the chamber in the lock housing. A pin 38 inserted through an opening 39 in the movable bolt 14. A washer 41 is retained between the pin and the other end of the spring. Thus the movable bolt is biased away from a keeper member 16 at all times toward the second wall 43 of the chamber. If the threads in the keeper member are stripped, the spring 36 will immediately withdraw the bolt from the keeper and the home owner will immediately know that the lock is not functioning properly. When the door is not locked, spring 36 will bias the bolt so that pin 38 is moved against plug 42 which is frictionally retained in the housing.

The keeper member 16 is attached to the other of said interlocking frame members such as member 4 as by screws 17 and 18. The keeper is formed with a threaded opening 19 and is positioned for threaded registration with the movable bolt. The keeper is formed with indents 46 and 47 so that the screw heads will protrude beyond face 48 of the keeper. The keeper is dimensioned so that face 48 is flush with face 49 of flange 23. This prevents a prying bar from being inserted between keeper face 48 and end face 50 of lock housing 9 or any part of frame member 5.

Where the lock is to be mounted for locking from the inside only, the lock member may be simply provided with a finger engageable handle 20 to rotate the threaded bolt.

Preferably, the lock housing is mounted on the movable panel member 2 and the keeper member is mounted on the immovable panel 3.

Figure 3:
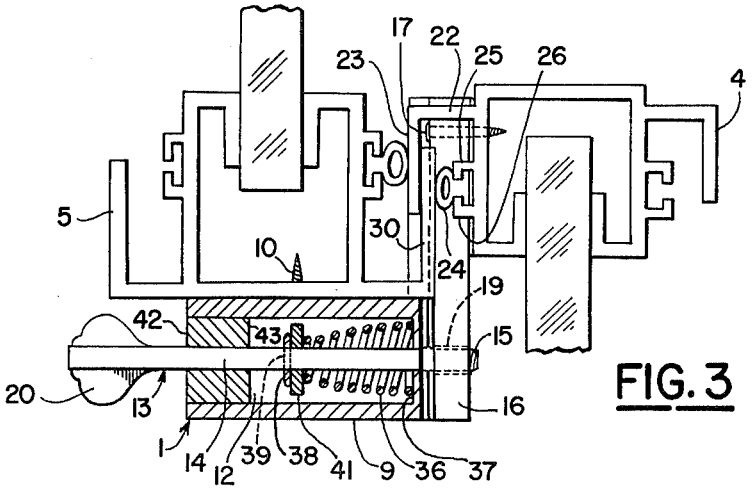
FIG. 3 is a cross sectional view of a portion of the sliding panels and lock taken along line 3—3 of FIG. 4 in the interlocked and locked position.
Figure 4:
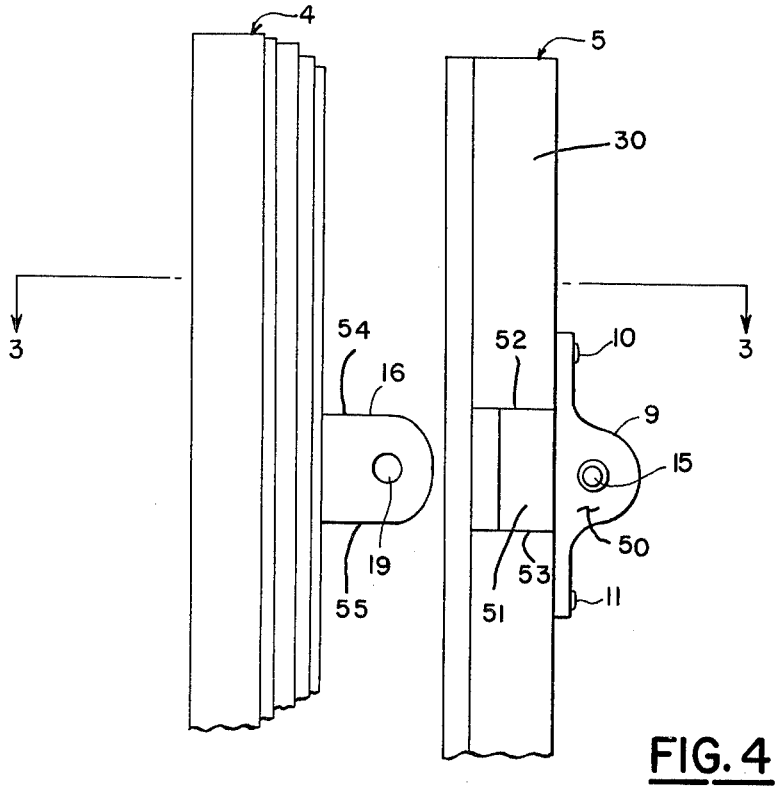
FIG. 4 is a side view of a portion of the panels shown in FIGS. 1-3.
Figure 5:
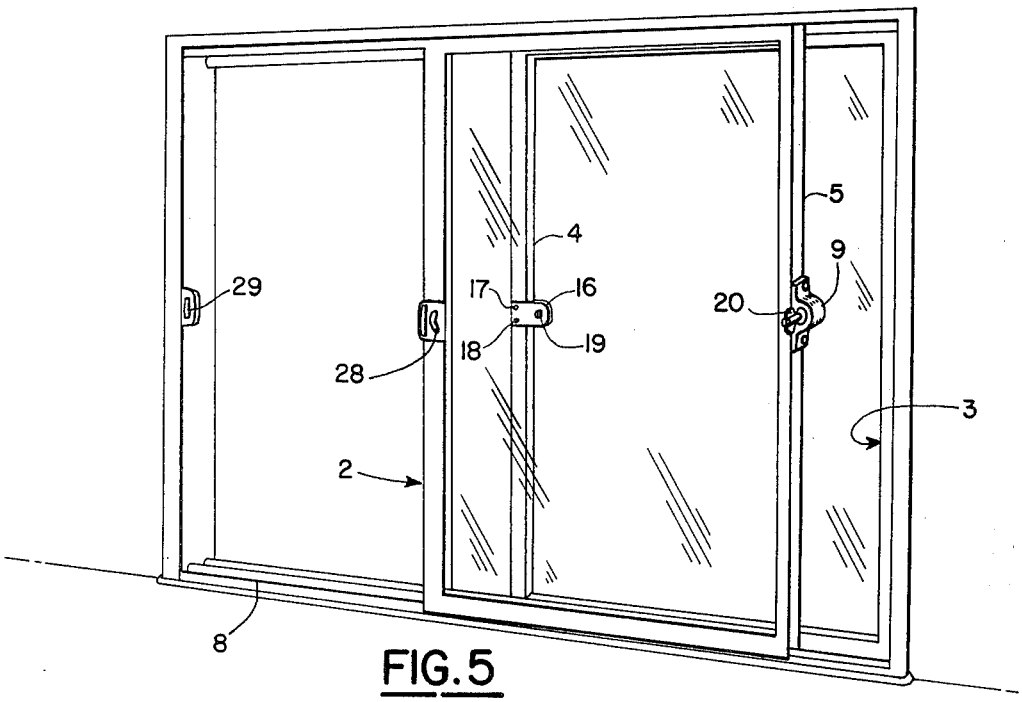
FIG. 5 is a perspective view of a sliding patio door or window with the lock of the present invention installed.

Installation of the lock means is best understood by referring to FIGS. 1, 3 and 5. Referring specifically to FIG. 1, the keeper is installed by first removing a section of flange members 22 and 23, sealing member 24 and sealing holding flanges 25 and 26 forming a notch 44. The keeper is then affixed to frame 4 by screws 17 and 18. Next, housing 9 is attached to frame 5 by one-way screws 10 and 11 in a position such that the threaded bolt 14 will match with the threaded opening 19 in the keeper member 16.

Preferably the lock housing is mounted at a convenient location on the frame such as the same elevation as the door handle 28 on patio doors. Where the door lock is mounted on sliding windows, a convenient location on the frame may be chosen.

A portion of flange 30 on panel 5 is removed forming a notch 51 with an upper edge 52 for registration with the upper edge 54 of keeper 16 and a lower edge 53 for registration with the lower edge 55 of keeper 16.

Figure 2:
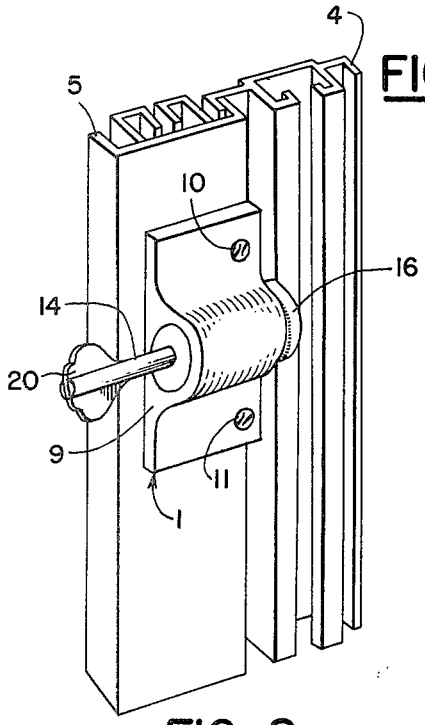
FIG. 2 is a perspective view of a portion of the sliding panels shown in FIG. 1 in the closed interlocked and locked position.

Operation of the lock is as follows. The movable panel with handle member 28 and standard latch member 29 is moved from the open position as shown in FIG. 1 to the closed position shown in FIG. 2. Flange 30 on moveable panel 5 moves into interlocking relation with the fixed panel between flange 23 and flange 26. As shown in FIG. 3, the threaded bolt is moved into registration with the threaded opening 19 in the keeper 16. The handle 20 is rotated and the threaded bolt 14 moves axially into threaded registration with the opening in the keeper. To facilitate closure, leading edge 31 of the keeper is chamfered.

The movable panel cannot be moved vertically and lifted out of the frame because the panel is affixed to the immovable panel by the threaded both within the keeper member. Moreover no relative displacement can occur between the panels because either the top 54 or bottom edge 55 of keeper 16 will catch on the upper edge 52 or lower edge 53 of notch 51 of flange 30. Thus, if anyone attempts an entry through the doors or window, the fact that the keeper 16 interlocks with the flange 30 of the door or window frame takes much of the stress of the threaded bolt 14.

There is no way to displace the door or window panels laterally with respect to each other because the notch opening 44 cut in flange 23 does not provide any space for the entry of a prying bar.

Entry can, of course, be gained by breaking out the entire panel of glass. Burglaries are seldom attempted in this manner, however, because the breaking glass generally attracts the attention of neighbors or security officers.

I claim:

1. A lock in combination with a pair of closure panels each having a frame member formed with flanges which interlock upon closure and at least one of said panels is slidably mounted in a track; said lock comprising:

a. a lock housing affixed to said flange of one of said interlocking frame members and formed with a chamber having first and second axially spaced end walls;

b. a lock bolt mounted in said housing for rotatable and axial reciprocating movement having a threaded portion at one end and a manually engageable member at the other end;

c. a spring retainer connected to a mid portion of said lock bolt;

d. a spring mounted within said chamber between said first wall of said chamber and said spring retainer and mounted to bias said spring retainer toward said second wall;

e. a keeper mounted in a notch formed in said flange of the other of said interlocking frame members and formed with a threaded opening for threaded registration with said movable bolt; and f. said flange holding said lock housing is formed with a notch for registration with said keeper when said panels are in the closed position to prevent relative vertical movement of said panels.

2. A lock as described in claim 1 comprising:

a. said spring is a cone spring.

3. A lock as described in claim 1 comprising:

a. said spring retainer includes a pin mounted on said bolt and a washer mounted on said bolt between said pin and said spring.

* * * * *

UNITED STATES PATENT AND TRADEMARK OFFICE

CERTIFICATE OF CORRECTION

PATENT NO. : 4,190,272

DATED : February 26, 1980

INVENTOR(S) : Eugene R. Beard

It is certified that error appears in the above-identified patent and that said Letters Patent are hereby corrected as shown below:

Column 2, line 4, delete [known] and insert --- know ---

Column 2, line 56, after heads will add --- not ---

Column 3, line 36, delete [both] and insert --- bolt ---

Signed and Sealed this

*Seventeenth* Day of *June 1980*

[SEAL]

*Attest:*

SIDNEY A. DIAMOND

*Attesting Officer*

*Commissioner of Patents and Trademarks*